US008579741B2

(12) United States Patent
Heland

(10) Patent No.: US 8,579,741 B2
(45) Date of Patent: Nov. 12, 2013

(54) PLAYING OBJECT HAVING A BOUNCE WITH LIMITED UNPREDICTABILITY

(75) Inventor: Jan Von Heland, Danderyd (SE)

(73) Assignee: Waboba Limited, Wanchai, Hong Kong (CN)

( * ) Notice: Subject to any disclaimer, the term of this patent is extended or adjusted under 35 U.S.C. 154(b) by 292 days.

(21) Appl. No.: 12/951,894

(22) Filed: Nov. 22, 2010

(65) Prior Publication Data

US 2012/0071281 A1 Mar. 22, 2012

(30) Foreign Application Priority Data

Sep. 20, 2010 (EP) ..... 10177653

(51) Int. Cl.
*A63B 37/14* (2006.01)

(52) U.S. Cl.
USPC ..... 473/595; 473/614

(58) Field of Classification Search
USPC ..... 473/572–576, 595, 596, 614, 451; 119/707; D21/707, 713; 273/153 S
See application file for complete search history.

(56) References Cited

U.S. PATENT DOCUMENTS

| | | | | | |
|---|---|---|---|---|---|
| 563,170 | A | * | 6/1896 | Haley et al. | 473/595 |
| 1,299,092 | A | * | 4/1919 | Abrahamson | 473/595 |
| 2,031,240 | A | * | 2/1936 | Van Deest | 473/595 |
| D138,150 | S | * | 6/1944 | Davidson | D21/707 |
| 2,362,064 | A | * | 11/1944 | Giesinger | 473/595 |
| 2,521,703 | A | * | 9/1950 | Emmitt | 473/596 |
| 2,546,896 | A | * | 3/1951 | Kassuba | 473/596 |
| 2,783,046 | A | * | 2/1957 | Lien | 473/596 |
| 3,450,592 | A | * | 6/1969 | Conrad et al. | 473/595 |
| 3,661,790 | A | | 5/1972 | Dean et al. | |
| 3,887,183 | A | * | 6/1975 | Saso | 473/76 |
| 3,931,971 | A | * | 1/1976 | Harvey | 473/595 |
| 3,980,300 | A | | 9/1976 | Hornsby, Jr. | |
| 4,452,454 | A | * | 6/1984 | Greene | 273/153 S |
| 4,600,199 | A | * | 7/1986 | Krell | 273/153 S |
| 4,889,340 | A | * | 12/1989 | Greene | 273/153 S |
| 4,952,190 | A | | 8/1990 | Tarnoff et al. | |
| D317,805 | S | * | 6/1991 | Swan | D21/707 |
| 5,026,054 | A | | 6/1991 | Osher et al. | |
| 5,190,504 | A | | 3/1993 | Scatterday | |
| 5,207,420 | A | * | 5/1993 | Crawford et al. | 119/707 |
| 5,294,112 | A | | 3/1994 | Smith | |
| D358,858 | S | * | 5/1995 | McGreevy | D21/707 |
| D372,749 | S | * | 8/1996 | Klundt | D21/707 |
| 5,647,809 | A | | 7/1997 | Yip | |

(Continued)

FOREIGN PATENT DOCUMENTS

| | | |
|---|---|---|
| WO | WO 95/01818 | 1/1995 |
| WO | WO 2006/121380 A1 | 11/2006 |

OTHER PUBLICATIONS

Extended European Search Report in corresponding European Patent Application No. 10177653.2 mailed Feb. 14, 2011, 7 pages.

*Primary Examiner* — Steven Wong
(74) *Attorney, Agent, or Firm* — Myers Bigel Sibley & Sajovec, PA

(57) ABSTRACT

The present invention relates to a playing object (21) having a main surface (13, 14, 16) enclosing and provided around a center of gravity, said main surface being provided with elements (22) in a pattern around the center of gravity, where each element has an element surface extending away from the main surface. The playing object may be a polyhedron and some of the elements may have a different appearance than the majority of elements.

13 Claims, 8 Drawing Sheets

(56) References Cited

U.S. PATENT DOCUMENTS

| | | | | |
|---|---|---|---|---|
| 5,722,657 | A * | 3/1998 | Cabrera | 273/153 S |
| 5,928,053 | A | 7/1999 | Henderson | |
| 6,224,513 | B1 | 5/2001 | Chow | |
| 6,398,677 | B1 | 6/2002 | Hergert et al. | |
| 6,443,863 | B1 * | 9/2002 | Dinoffer | 473/595 |
| 6,514,164 | B1 | 2/2003 | Parrett | |
| 6,533,637 | B1 | 3/2003 | Liao | |
| 6,537,125 | B1 | 3/2003 | Motosko, III | |
| 6,905,431 | B2 | 6/2005 | Pearce et al. | |
| D516,640 | S * | 3/2006 | Shore | D21/707 |
| D519,588 | S * | 4/2006 | Carbonero | D21/707 |
| 7,413,524 | B1 * | 8/2008 | Bibby | 473/595 |
| 7,559,862 | B2 | 7/2009 | Von Heland | |
| 7,670,658 | B1 | 3/2010 | Roberts | |
| D619,663 | S * | 7/2010 | Quinn | D21/713 |
| D626,610 | S * | 11/2010 | Grimm | D21/707 |
| D627,837 | S * | 11/2010 | Chapa, Jr. | D21/707 |
| D629,056 | S * | 12/2010 | Grimm | D21/707 |
| D646,343 | S * | 10/2011 | Chapa, Jr. | D21/707 |
| 2001/0014633 | A1 | 8/2001 | Moore | |
| 2004/0048018 | A1 | 3/2004 | Pearce | |
| 2004/0249322 | A1 | 12/2004 | Cohen | |
| 2006/0063623 | A1 | 3/2006 | Zheng | |
| 2008/0083571 | A1 | 4/2008 | Troy | |
| 2011/0207564 | A1 * | 8/2011 | Goodall et al. | 473/595 |
| 2011/0218064 | A1 * | 9/2011 | Bibby | 473/595 |

* cited by examiner

PLAYING OBJECT HAVING A BOUNCE WITH LIMITED UNPREDICTABILITY

CROSS-REFERENCE TO RELATED APPLICATIONS

This U.S. non-provisional patent application claims priority under 35 U.S.C. §119 to European Patent Application No. 10177653.2, filed on Sep. 20, 2010, the disclosure of which is hereby incorporated by reference in its entirety.

TECHNICAL FIELD OF THE INVENTION

The present invention generally relates to a playing object and in particular to a playing object having a bounce with a limited unpredictability.

BACKGROUND OF THE INVENTION

Balls have for many years been provided for entertainment and amusement of both children and adults. Balls are normally used in such a way that they can bounce at an angle off a hard surface.

When using a ball in various games it is of interest that the bounce is predictable. This means that a player of a game should be able to understand the bounce in order to catch or hit it properly.

However, it is in some games also of interest to have a mostly predictable behavior, which at times is unpredictable. A game involving bouncing and some score based on catching the ball after a bounce, will thus need a bounce that is predictable in most cases. However, a certain amount of unpredictability will increase the fun of the game. It is therefore of interest with a bounce that has a certain degree of or limited unpredictability.

One example of a ball-like playing object having a bounce with a certain degree of unpredictability is disclosed in WO 95/01818, which playing object is described as being suitable for sharpening the catching skills in the game of cricket. This playing object is made up of a polyhedron with a number of faces.

Another example is disclosed in U.S. Pat. No. 6,443,863, where a sports training ball designed to develop reaction and reflection skills is described. The ball is spherical and on the surface of it there are provided seven semispherical knobs, providing an erratic bounce.

The erratic or unpredictable behavior of the first mentioned playing object, despite not being spherical, is not erratic or unpredictable enough for some games, while the bounce of the sports training ball is too erratic or unpredictable to be used in these games.

Another ball that exists is described in U.S. Pat. No. 5,928,053. This ball, which is hollow, is also spherical and covered by hemispheric projections.

There is therefore a need for a playing object that has a bouncing behavior that is in-between the behavior of the above-mentioned playing object and sports training ball.

For the reasons stated above, and for other reasons stated below which will become apparent to those skilled in the art upon reading and understanding the present specification, there is a need in the art for an improved playing object.

SUMMARY OF THE INVENTION

The above-mentioned problems with balls and playing objects are addressed by the present invention and will be understood by reading and studying the following specification.

One object of the present invention is therefore directed towards solving the problem of providing a playing object having a bounce with limited unpredictability.

This problem is according to the invention solved through a playing object having a main surface enclosing and provided around a center of gravity, the main surface being provided with elements in a pattern around the center of gravity, where each element has an element surface extending away from the main surface, wherein some of the elements differ in appearance from a majority of the elements.

The elements may be protrusions and the element surfaces protrusion surfaces distanced from the main surface in a direction that is opposite to the direction from the main surface to the center of gravity of the playing object.

The elements can also be cavities and the element surfaces bottom surfaces of the cavities distanced from the main surface in a direction from the main surface towards the center of gravity of the playing object.

The difference in appearance can be a different size, a different height and a different shape.

According to some embodiments of the invention, the main surface is a sphere. In other variations it is an ellipsoid.

According to some further embodiments of the present invention related to protrusions, the main surface is a polyhedron surface and a protrusions surface has the same appearance as the part of the polyhedron surface from which it protrudes. The distance from the main surface to the center of gravity can be k times larger than the height H1 of the majority of the protrusion surfaces above the polyhedron surface, where k is in the range of 2.5-4.5. The protrusions may furthermore cover 15-75% of the main surface.

The elements can also be arranged along at least three circular or elliptical paths. In some variations these paths are furthermore provided around the center of gravity, where at least three of the paths are provided in planes perpendicular to each other. In this case one element of different appearance than the majority can be provided in each of the circular or elliptical paths provided in planes perpendicular to each other. Alternatively all elements of one path may differ from the elements of the other paths.

It is also possible that in relation to the plane in which one of the paths is provided all other paths have a gap between elements perpendicular to this plane.

When the elements are protrusions, these protrusions may also have at least one side being joined to the underlying main surface and forming a protrusion circumference at the interface with the underlying main surface, where the distance to the center of the protrusion varies along the protrusions circumference.

It is furthermore possible that the protrusions are placed on the main surface so that the distance between the center of one protrusion and the center of a first neighboring protrusion is different from the distance between the center of said one protrusion and the center of a second neighboring protrusion.

At least some protrusions may also be detachable, for instance the protrusions that differ in appearance from the majority. This means that it is possible for a user to select the type of erratic behavior that is desired.

Some protrusions may furthermore be joined with each other for forming a playing object surface with cavities, which cavities are formed by parts of the main surface provided in-between joined protrusions.

The invention is furthermore directed towards a playing object comprising a regular polyhedron with a surface made up of at least ten faces enclosing and provided around a center of gravity, wherein the polyhedron surface comprises elements in a regular pattern around the center of gravity, where the elements have element surfaces extending in a direction away from the polyhedron surface. The element may here be a protrusion and the element surface a protrusion surface distanced a distance from the main surface in a direction that is opposite to the direction from the main surface to the center of gravity. The element may also be a cavity and the element surface a bottom surface of the cavity distanced a distance from the main surface in a direction from the main surface towards the center of gravity.

With the present invention there is therefore provided a playing object that has good predicable bouncing ability, with the elements providing a slight erratic behavior. This enables the playing object to increase the fun of games that are based on the bouncing of the playing object. The elements can also be used for obtaining surprising and enjoyable spin effects, which increases the unpredictable behavior of the playing object after bounces.

DETAILED DESCRIPTION OF THE INVENTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims.

The invention is based on a modified basic playing object, which may be a sphere, ellipsoid or a polyhedron. According to one variation of the invention one such basic object being modified is the polyhedron playing object described in WO 95/01818, which document is herein incorporated by reference.

Figure 1:
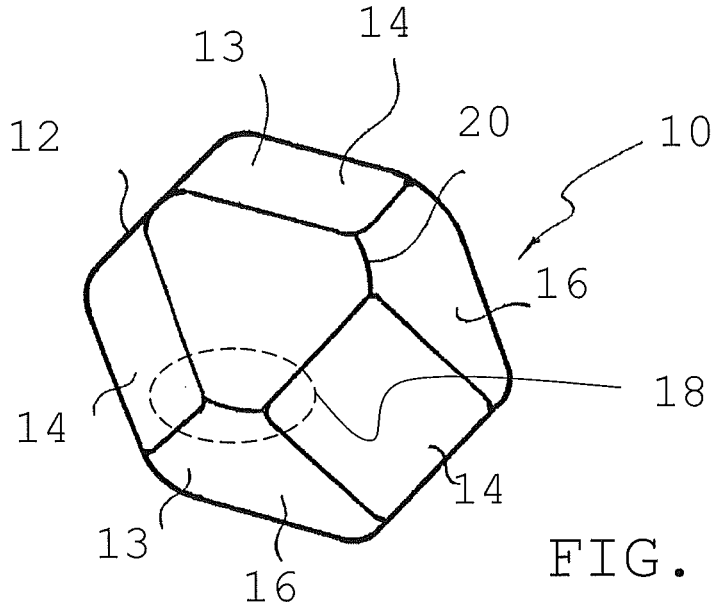
FIG. 1 is a perspective view of a polyhedron before being modified for obtaining a playing object according to some variations of the invention.

This polyhedron is more particularly shown FIG. 1. The polyhedron is a multi-sided geometric body 12 having a plurality of planar faces 13. In this exemplifying polyhedron, which is a modified cuboctahedron, the planar faces 13 are comprised of six square faces 14 and eight hexagonal faces 16 providing a total of fourteen faces. The square faces 14 are arranged in opposing pairs such that each pair is disposed at opposite sides of the body 12. They are therefore also provided on opposing sides of a center of gravity in the centre of the polyhedron. The hexagonal faces 16 are also arranged in opposing pairs at opposite sides of the body 12 such that opposing hexagonal faces 16 are disposed in opposing directions with respect to each other. Each hexagonal face 16 comprises three sides 18 which correspond in length to the sides of the square faces 14. Located between the three sides are three shorter sides 20 so that located opposite each side 18 in a hexagonal face is a shorter side 20. The hexagonal faces are each made up from triangular faces, the corners of which have been truncated in order to provide these shorter sides 20. In this way the faces of the polyhedron make up the surface of the playing object.

Because the forming of the hexagonal faces are obtained from triangles with truncated corners, two short sides of two adjacent hexagonal sides together with the corners of two square sides on opposite sides of these short sides make up a vertex of the polyhedron. In FIG. 1 an area 18 covering such a vertex is schematically indicated.

The square faces 14 and hexagonal faces 16 are arranged such that a square face 14 is surrounded by four hexagonal faces 16. In this the sides of the square faces 14 are contiguous with sides of the hexagonal faces 16 to form edges. The body 12 is constructed such that adjoining faces are inclined to each other at an angle, which in this example is an angle of 125° 16'. The polyhedron surface here makes out a main surface of the playing object, which will be modified in a number of ways to be described later.

This polyhedron does have a limited erratic bouncing behavior. However, it is of interest to increase this erratic bouncing behavior in order to enable the provision of a more unpredictable bounce and thereby to obtain more exciting games. The present invention is directed towards this.

The invention does this through providing the playing object with elements in a pattern around the center of gravity of the playing object, where each element has an element surface extending away from a main surface. In one variation of the invention these elements are protrusions, projections or protuberances stretching away from the main surface in a direction that is opposite to the direction from the main surface to the center of gravity of the playing object. In another variation the elements are cavities, holes or depressions stretching away from the main surface in a direction towards the center of gravity of the playing object.

According to one variation of the present invention the above described vertices are provided with these protrusions. In an embodiment of the invention that is based on this variation the protrusions are provided around each vertex of the polyhedron. The polyhedron surface therefore makes up a main surface on which protrusions are provided. The protrusions are furthermore with advantage provided in a pattern around the center of gravity. This pattern may be a regular pattern through an organization in circular or elliptical paths round the playing object and the center of gravity.

Figure 2:
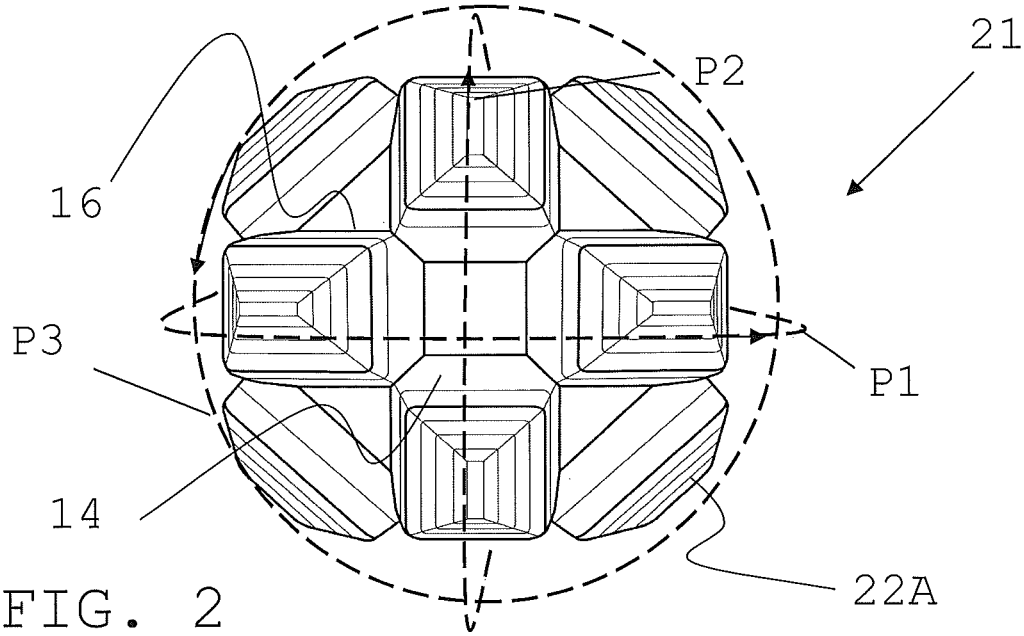
FIG. 2 is a front view of a playing object according to one embodiment of the invention.

A playing object 21 according to this embodiment of the invention is shown in a front view in FIG. 2. The playing object is in this embodiment based on the above-mentioned cuboctahedron with square 14 and hexagonal faces 16. As mentioned above, each vertex has in this embodiment been provided with a protrusion 22A. The protrusions are arranged along a number of circular paths P1, P2 and P3 around the centre of gravity, which number is three in this embodiment. Each path is thus provided in a plane that stretches through the centre of gravity of the playing object and these planes are all perpendicular to each other. At least three of the circular paths P1, P2 and P3 are thus provided in planes perpendicular to each other. Thus in this embodiment the three paths are provided in three different planes, where each of these planes is perpendicular to both the other planes. There is thus a first path P1, provided as a circle in the horizontal plane of the drawing, a second path P2 provided as a circle in the vertical plane of the drawing and a third path P3, provided as a circle in the plane of the paper, perpendicular to both the vertical and horizontal planes. It can furthermore be seen that in the described embodiment none of the paths share any protrusions. A protrusion does therefore only belong to one path. Moreover, in relation to a certain path provided in a certain plane the other paths lack protrusions extending from the polyhedron surface at right angles to this plane. In the part of the polyhedron surface that is perpendicular to the plane in which a path of protrusions is placed, there is thus a gap between protrusions. This gap will then be common to both the other paths. This is in the first embodiment combined with protrusions in each path being provided at ninety degrees from other protrusions along the whole path. This means that there are at least four protrusions in a path around the center of gravity, where these protrusions are placed at 0/360 degrees, at 90 degrees, at 180 degrees and at 270 degrees. There may here be more protrusions in-between. It can therefore be seen that there are provided two pairs of protrusions in each path, where the protrusions of a path are provided on opposite sides of the center of gravity. In this embodiment the pairs are shifted ninety degrees from each other along this path.

The placing of protrusions on the polyhedron surface may be varied. This varying may relate to how protrusions are placed in a path. The pairs of a path may be separated from each other by a different angle than the one described above. They may for instance be separated by forty-five degrees. It is also possible that the provision of gaps perpendicular to the plane of a path is only made in relation to one path.

Figure 3:
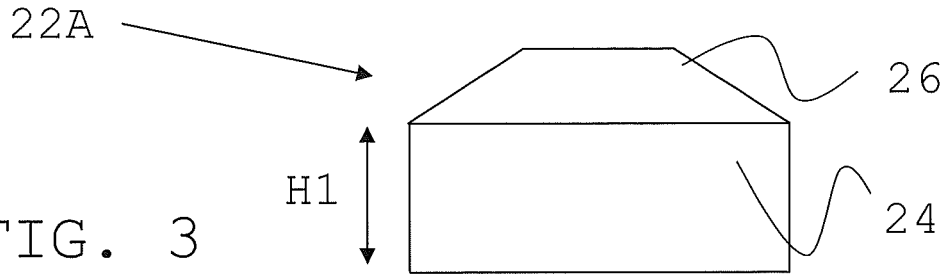
FIG. 3 is a front view of a protrusion in the playing object of FIG. 2.

As can be seen in FIG. 3, which shows a side view of a first type of protrusion 22A, the protrusion 22A is in this embodiment shaped as a house, with a distancing element 24 making up the "walls" of the house and with a protrusions surface 26 formed as the "roof". The protrusion surface is furthermore in essence formed and angled in the same way as the enclosed area in FIG. 1. The distancing element is thus formed as a rectangular prism. In this example the protrusion surface 26 or "roof" therefore has two opposing elements corresponding to two opposed square faces and two opposing elements corresponding to two hexagonal faces, where the elements are provided at the above described angles to each other. The sides separating the elements may here also be rounded. The protrusion surface 26 is furthermore provided at a distance from or at a first height H1 above the surface of the polyhedron, which distance is provided through the distancing element 24. The protrusion surface is distanced a distance from the main surface in a direction that is opposite to the direction from the main surface to the center of gravity of the playing object. The first height H1 is thus determined through the distance from the polyhedron surface created by the distancing element 24. In this first embodiment all protrusions are provided at this first height H1. In this first embodiment the sides of the protrusion making up the "walls" furthermore have different lengths. These sides are thus joined with the underlying polyhedron surface and form a protrusion circumference at the interface with the polyhedron surface, where the distance to the center of the protrusion varies along this protrusions circumference.

It can thus be seen from FIGS. 2 and 3 that the protrusions 22A have a protrusion surface 26 at a distance from the polyhedron surface in a direction away from the center of gravity. The distance from a part of a polyhedron face covered by a protrusion to the centre of gravity is furthermore k times larger than the height of this protrusion surface, where k is in the range of 2.5-4.5. In this embodiment k is approximately 2.7. This means that for a polyhedron with a face provided 22 mm from the centre of gravity, the height of the protrusion area above the face may be 8 mm.

Furthermore, the protrusions do with advantage cover 15-75% of the polyhedron surface. They may preferably cover 50-75% of the polyhedron surface.

The playing object obtained in this way has, because of the general polyhedron shape, good predicable bouncing ability, with the protrusions providing a slight increase in the erratic behavior. It can be seen that since the protrusions generally form a larger outer polyhedron of the same type having the same bouncing ability as an inner polyhedron, much of the original behavior is retained. However, because the protrusions are separated by gaps, i.e. do not cover the whole surface of the inner polyhedron, and provided at a distance from the inner polyhedron, a more erratic bounce is obtained. It can also be seen that the pattern of the placing of the protrusions on the surface also has an influence. The protrusions may be placed on the main surface so that the distance between the center of one protrusion and the center of a first neighboring protrusion is different from the distance between the center of said one protrusion and the center of a second neighboring protrusion. The playing object of the described embodiment will essentially have three types of impact surfaces. A first made up of a single protrusion, a second made up of four protrusions centered around a square polyhedron face and a third made up of three protrusions surrounding a triangular polyhedron face. A protrusion is then typically a part of both the second and third impact surface and will have a first distance to a first neighboring protrusion with which it assists in forming the second impact surface as well as have a second different distance to a second neighboring protrusion with which it assists in forming the third impact surface. All these types of impact surfaces give rise to different types of bounce and hence to increasing the erratic behavior of the playing object. Here it can also be seen that the appearance, for instance the shape and height, of the distancing element may be of importance in providing the playing object with an erratic bounce. The protrusions can also be used for obtaining surprising spin effects, which increases the unpredictable behavior of the playing object after bounces.

The number of vertices should be at least eight and the number of faces at least ten. The playing object is furthermore with advantage solid, although it may be hollow and filled with a gas such as air. It is also important that it is flexible, therefore it may be made of a flexible or elastic material like rubber, a rubber based material or a plastic material. The material can be solid or foamed. The material may as an example be natural rubber, silicone rubber, ethylene vinyl acetate (EVA) foam, soft polyvinyl chloride (PVC), TPR (Thermal Plastic Rubber), Thermoplastic Urethane (TPU) or polyurethane (PU). The playing object is furthermore with advantage shaped to be possible to hold in the hand and therefore as an example sized as a tennis ball. However larger or smaller sizes are possible such as sized as a baseball, basketball or a table tennis ball. The distance from a face to the centre of gravity may be in the range of 15-30 mm.

Here it can also be mentioned that a hard throw of the playing object will have a less erratic bounce than a soft throw. Furthermore, if the playing object is thrown with spin, the erratic behavior is increased even more. This means that a player can influence the occurrence and type of erratic bounce using various throwing techniques.

It is possible to increase the erratic behavior while still retaining a mostly predictable bounce.

Figure 4:
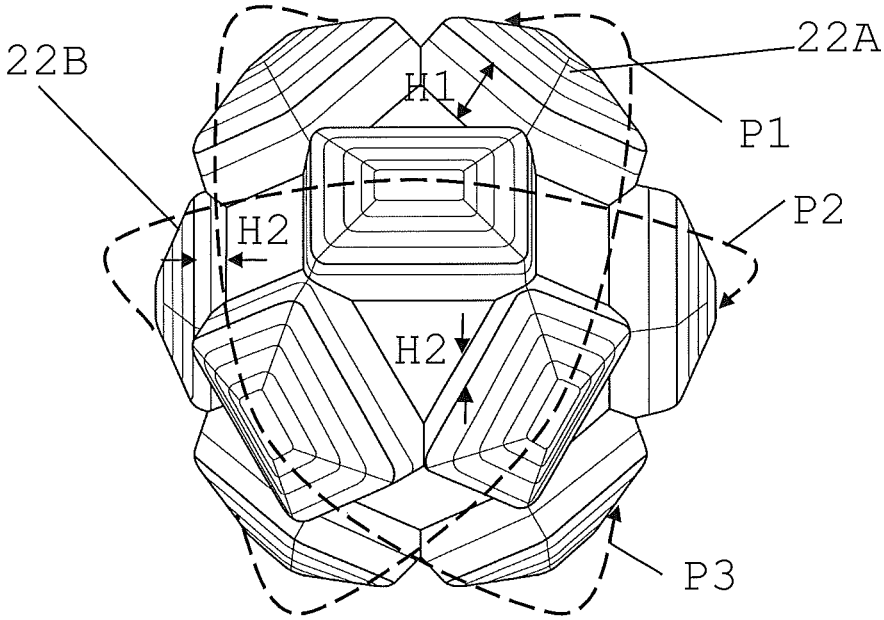
FIG. 4 is a perspective view of the front of a playing object according to another embodiment of the invention as viewed from above.
Figure 5:
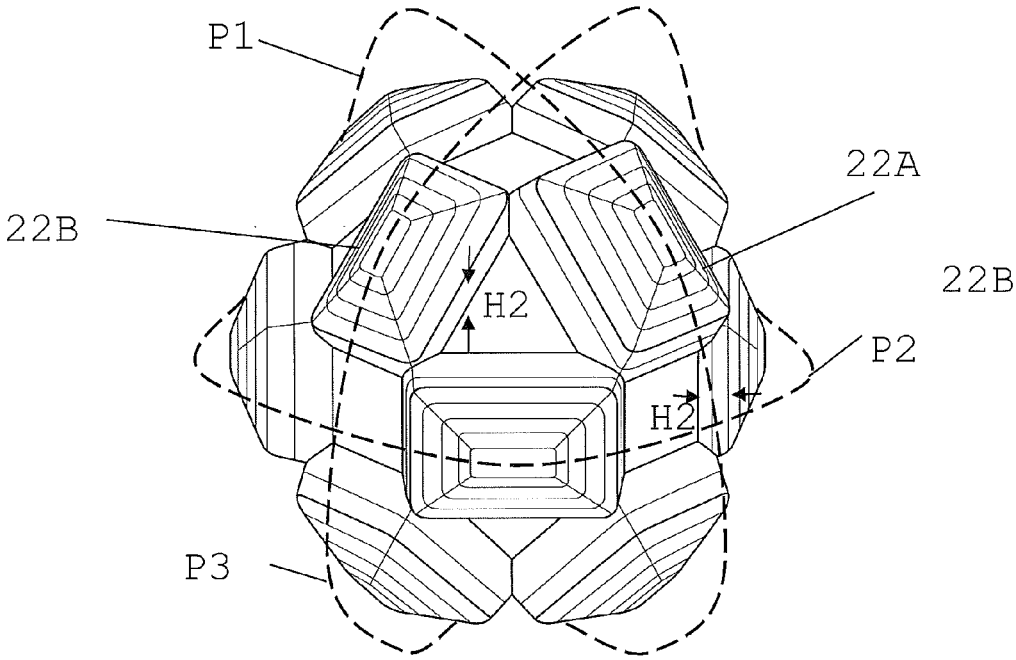
FIG. 5 is a perspective view of the back of the playing object in FIG. 4 as viewed from below.

FIGS. 4 and 5 are directed towards a playing object according to another embodiment of the invention, which is based on the same type of polyhedron as in the previously described embodiments. In FIG. 4 there is shown a perspective view of the front of the playing object seen from above and in FIG. 5 there is shown a perspective view of the back of the playing object seen from below. In most parts the playing object has the same shape and organization as in the previous embodiment. A majority of the protrusions 22A are therefore of the first type provided at the first height H1 above the polyhedron surface. However, in this embodiment some of the protrusions have a different appearance through having a different shape than this majority of the protrusions. In this embodiment the differing protrusions 22B are of a second type having a protrusions surface provided at a different second height H2 above the polyhedron surface. In this embodiment the differing height H2 is furthermore lower and here half the height H1 of the majority. This means that the second type of protrusion has the same protrusion surface and the same type of distancing element as the first type of protrusion, but the distancing element has a different height. In this embodiment only one protrusion in each path has this lower height H2. There is furthermore in this example also at least one protrusion having the ordinary height H1 of the majority of the protrusions between two protrusions with differing height, i.e. here with the height H2.

In this way the polyhedron can be considered to have its surface divided into equal sized parts, where each such part has one protrusion with differing height. In this way it is possible to provide a playing object that generally has a predictable behavior but increased erratic behavior or increased unpredictable bounce because of the limited numbered and evenly spaced protrusions with a different shape.

Another way to increase the erratic behavior is through concentrating the protrusions with differing appearance 22B to only one path. It is here possible to have only some protrusions of this single path to have differing appearance or shape. It is also possible with all of the protrusions.

Figure 6:
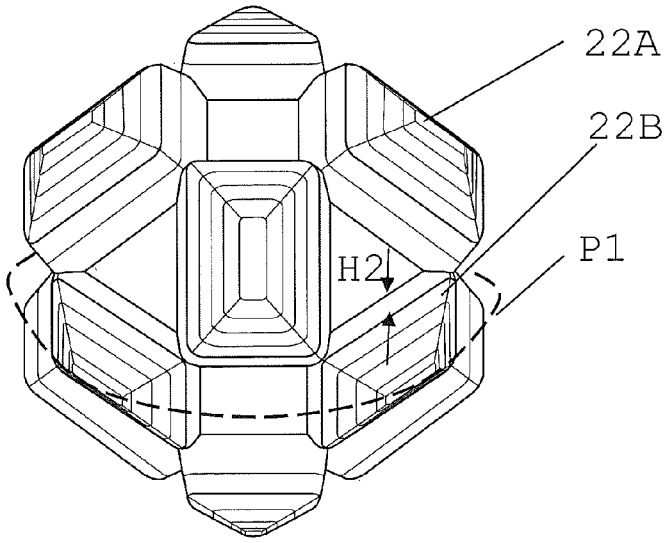
FIG. 6 is a perspective view of the front of a playing object according to a further embodiment of the invention as viewed from above.
Figure 7:
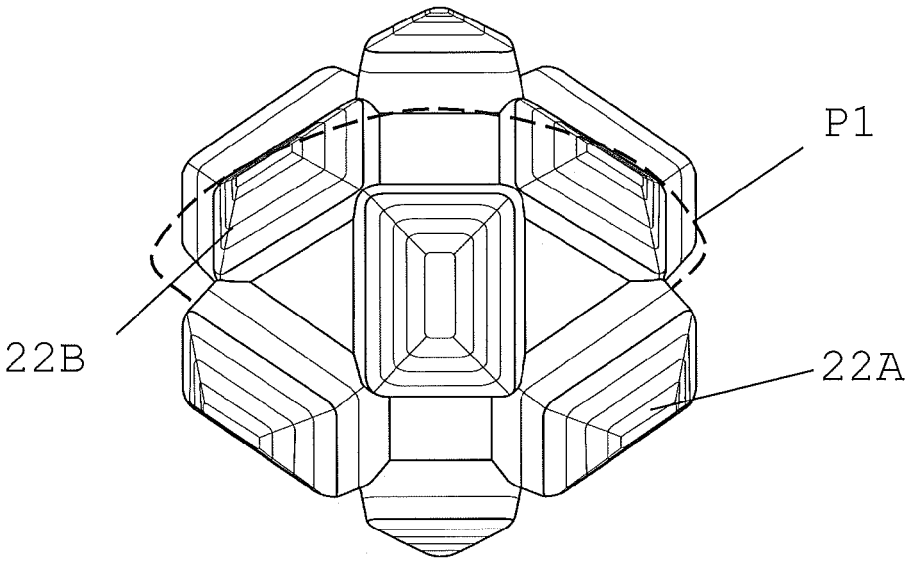
FIG. 7 is a perspective view of the back of the playing object in FIG. 6 as viewed from below.

A playing object according to a further embodiment of the invention is directed towards this latter case. This embodiment is shown in FIGS. 6 and 7, where FIG. 6 shows a perspective view of the front of the playing object seen from above and FIG. 7 shows a perspective view of the back of the playing object seen from the below. As can be seen here all protrusions in one path P1 have the second height H2, which is half the height of the protrusions of the other paths.

In the examples given above each vertex of the polyhedron was equipped with a protrusion. It should be realized that it is possible with fewer protrusions. It is likewise possible that a protrusion is centered to a face or a side instead. The various variations describe din relation to protrusions, especially in relation to protrusions in paths, may also be applied on cavities.

The playing object is not limited to polyhedrons, but can also be a sphere or an ellipsoid. Examples of spheres 30 are given in FIGS. 8-14.

The protrusion surfaces can furthermore have different shapes. They can for instance be shaped as hemispheres or ellipsoid halves. They can for instance also be planar and therefore have a different shape than the underlying structure. It is here possible that all will have the different shape or only some will have different shape than the underlying structure. It is also possible that it is the protrusions with different heights that have this differing protrusion surface. The distancing element may then be omitted and the desired distance may instead be provided through a radius of the sphere or ellipsoid. Alternatively the distancing element may be shaped as a cylinder or cube. It is of course also possible to combine a hemisphere and half an ellipsoid with a distancing element. The protrusion surface was above aligned with the sides of the distancing element. It should be realized that as an alternative it may extend beyond the sides of the distancing element. In the examples given above the protrusions with differing height was lower than the majority of protrusions. It can as an alternative be higher than the majority. It can also instead or in addition also have a different protrusion surface than the majority.

As the protrusions can be provided on different types of objects, the playing object can also be seen as having a main surface enclosing and provided symmetrically around a center of gravity, where this surface may then be a polyhedron surface, a sphere surface or an ellipsoid surface. The main surface is then provided with protrusions in a regular pattern around the center of gravity, where each protrusion has a protrusion surface distanced a distance from the main surface in a direction away from the center of gravity. This means that the protrusions stretch out from the main surface in a direction that is opposite to the direction from the main surface to the center of gravity of the playing object. Some of the protrusions also differ in appearance from the majority of the protrusions. The difference in appearance may here be a difference in shape and/or a difference in size, such as a difference in volume.

Figure 8:
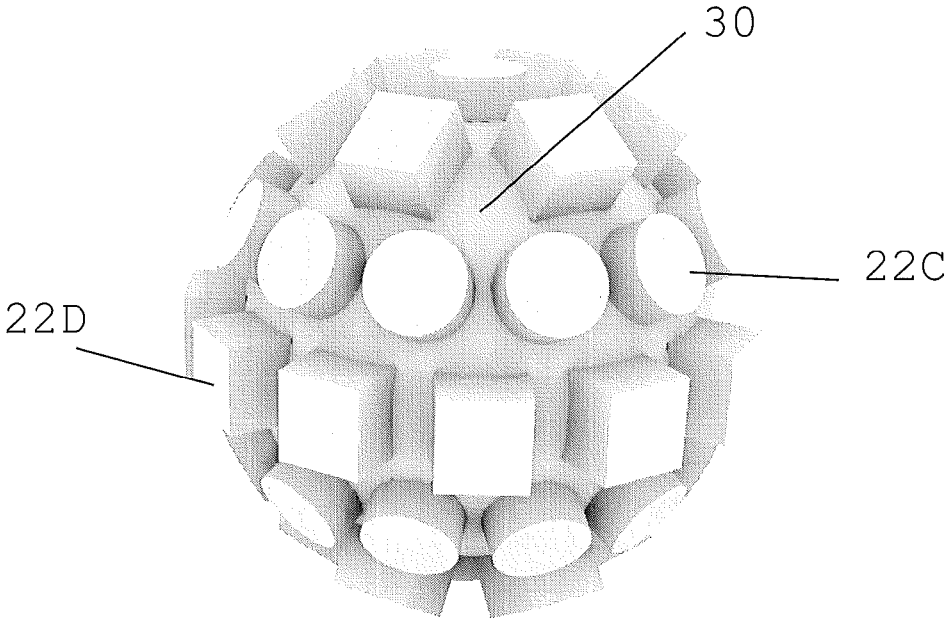
FIGS. 8-14 show perspective views of playing objects according to a number of further embodiments.
Figure 9:
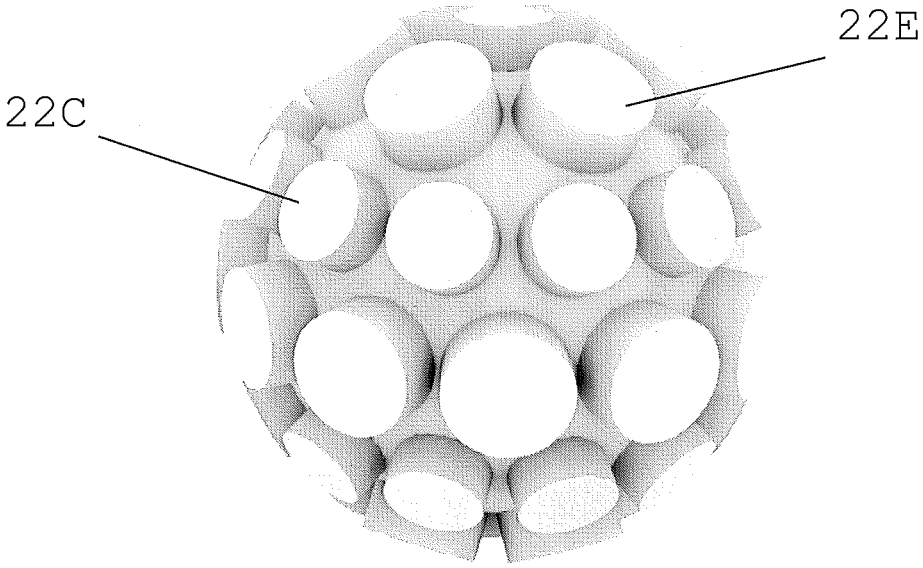
Figure 10:
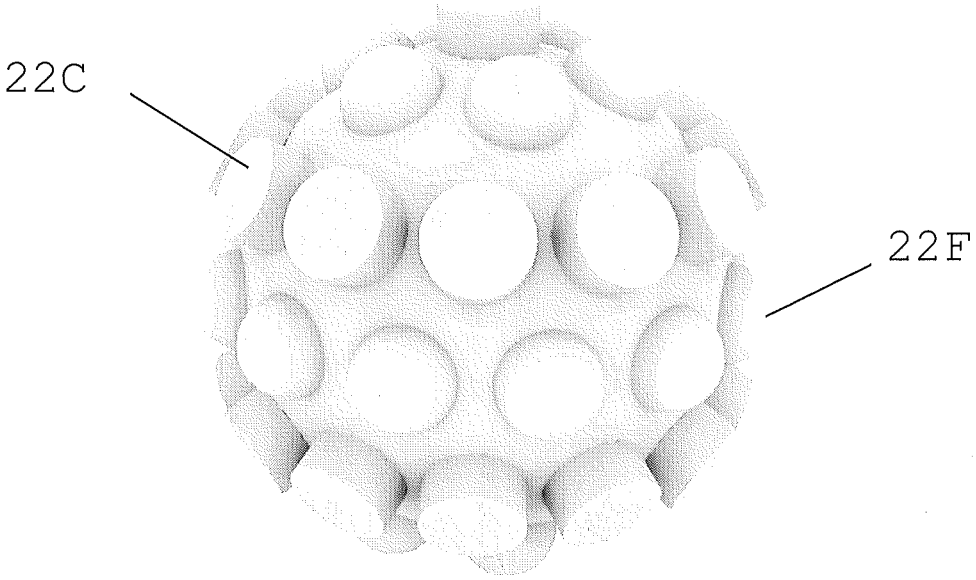
Figure 11:
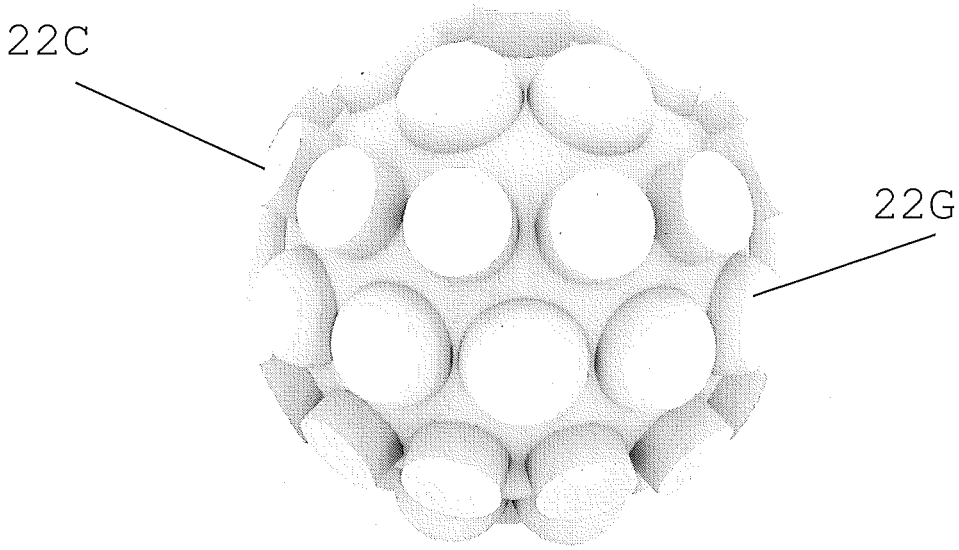
Figure 12:
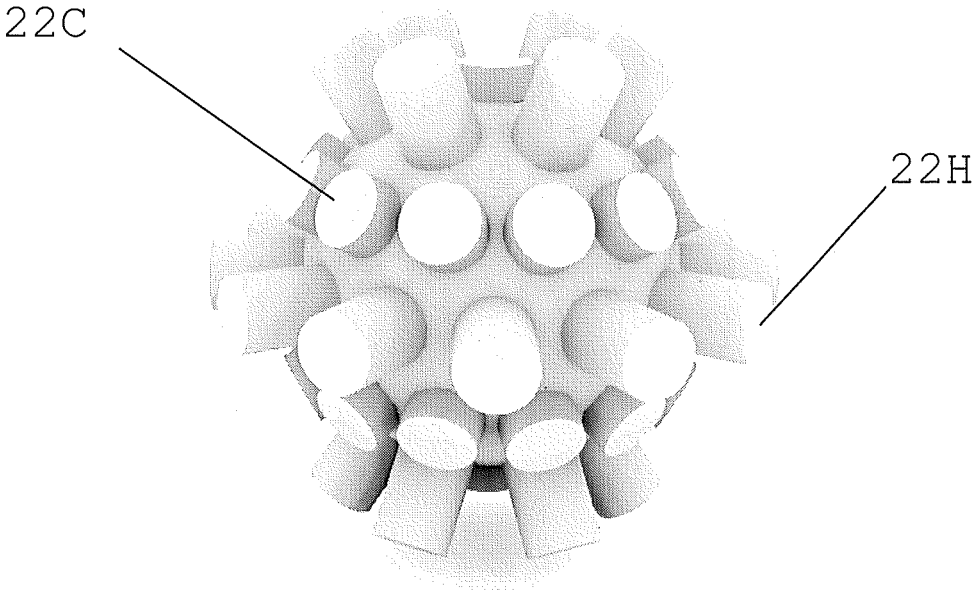
Figure 13:
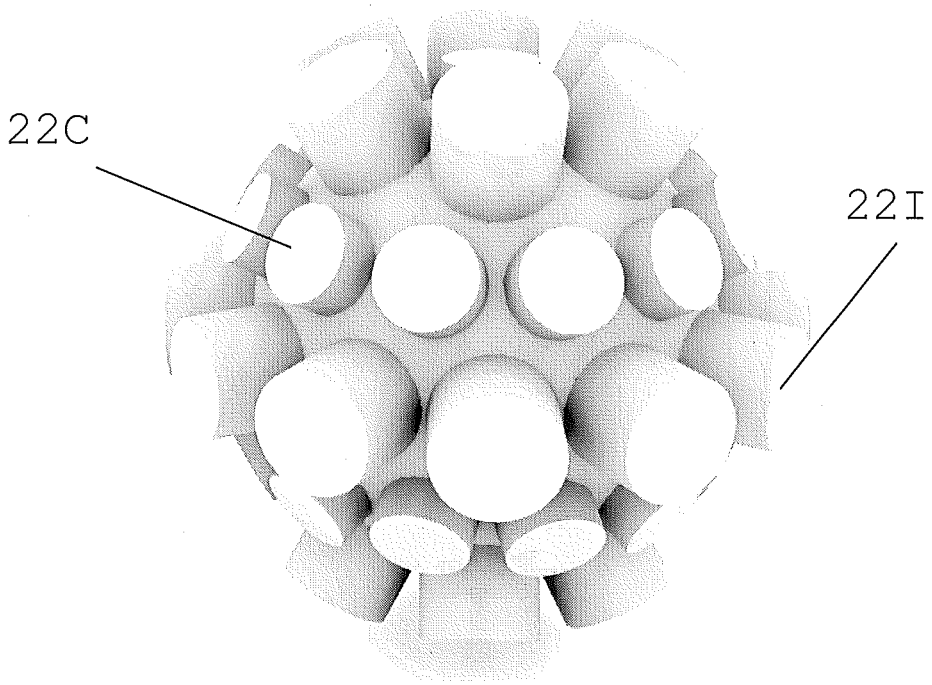
Figure 14:
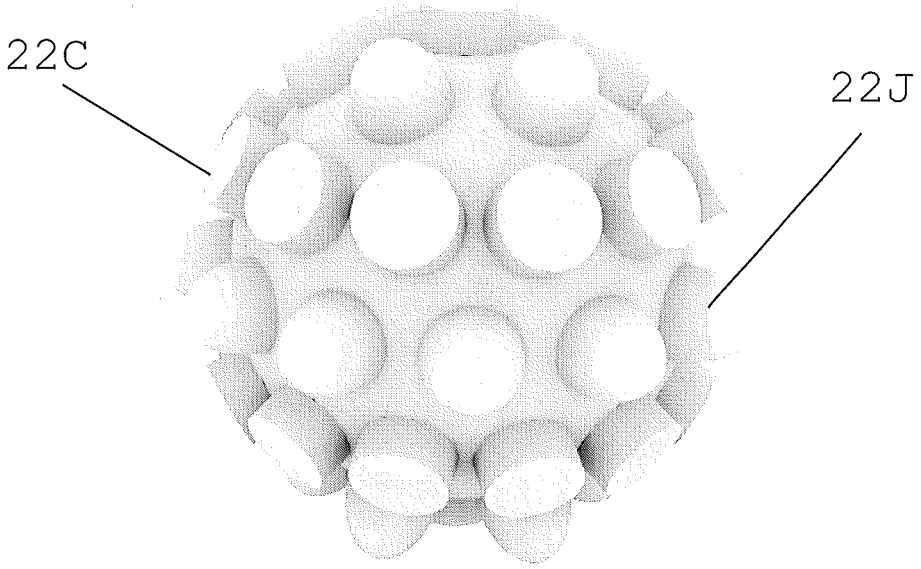

FIGS. 8-14 give a number of examples of different types of protrusions combined on a spherical main body 30. In FIG. 8 there is a variation where a cylinder shaped protrusion 22C of a third type having a circular protrusion surface with a first area provided at a first height above the main surface is combined with a second type of cubical protrusion 22D. Here the cubical protrusions are in majority. In FIG. 9 there is the first type of cylindrical protrusion 22C combined with a fourth type of protrusion 22E. This fourth type is also cylindrical but has a second larger circular protrusion surface area provided at the first height above the main surface. In FIG. 10 there is yet again the third type of protrusion 22C. However, it is here combined with a fifth type of protrusion 22F having a hemispherical shape with a first radius. FIG. 11 again shows the third type of protrusion 22C, however this time combined with a sixth type of protrusion 22G having a hemispherical shape with a second larger radius, i.e. a radius that is larger than the first radius. FIG. 12 yet again shows the first type of cylindrical protrusion 22C combined with a seventh type of protrusion 22H. This seventh type is also cylindrical and also has the circular protrusion surface area as the third type. However, the protrusion surface of this seventh type 22H is provided at another higher height above the main surface. FIG. 13 again shows the first type of cylindrical protrusion 22C combined with an eighth type of protrusion 22I. This eighth type is also cylindrical, has the same protrusion surface area as the fifth type of protrusion but is provided at the same height as the seventh type of protrusion surface. Finally FIG. 14 shows the third type of protrusion 22C combined with a ninth type of protrusion 22J, where the ninth type is shaped as half an ellipsoid. In FIGS. 8-14 the protrusions are organized in paths around the main surface. In these examples all protrusions in the same paths have the same appearance. It can also be seen that in these examples, the paths do not all encircle the center of gravity of the basic playing object.

It is furthermore possible that protrusions are removable. A user can in this way be able to attach and detach a protrusion. For this reason the protrusions may be provided with a first fastening means, which mates with a corresponding second fastening means in the underlying main surface. The first fastening means may here be a screw fastened in the bottom the distancing element which mates with a second fastening means in the form of a threaded hole in the main surface. It could also be a snap-in solution, like a spring in the bottom of a protrusion engaging with a recess in the main surface.

This allows users to change protrusions and thereby obtain different sorts of erratic behavior. Here all or only some protrusions may be detachable. It is for instance possible that only the above-mentioned protrusions with differing shape can be replaced.

The number of paths were above exemplified through three paths. It should however be realized that there may be more paths, not necessarily provided in planes perpendicular to each other. However, three such paths could in some variations of the invention be provided in planes perpendicular to each other. The number of paths may here depend on the relationship between protrusion surface size and main surface size. When there are protrusions with differing shapes in different paths, each such path may have to be provided in a plane that is perpendicular the planes of two other paths including protrusions with differing shape. The paths were also described as being circular. They can also, in dependence on the shape of the playing object, be elliptical.

Figure 15:
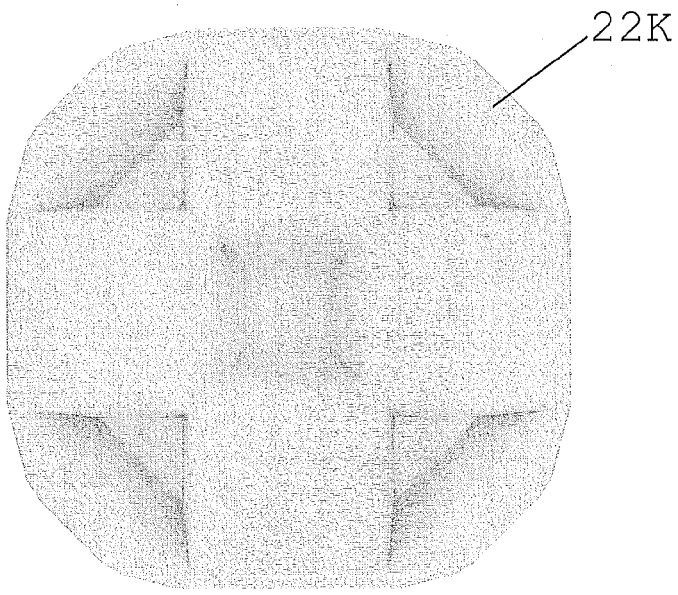
FIGS. 15 and 16 show views of a playing object with protrusions joined to each other.
Figure 16:
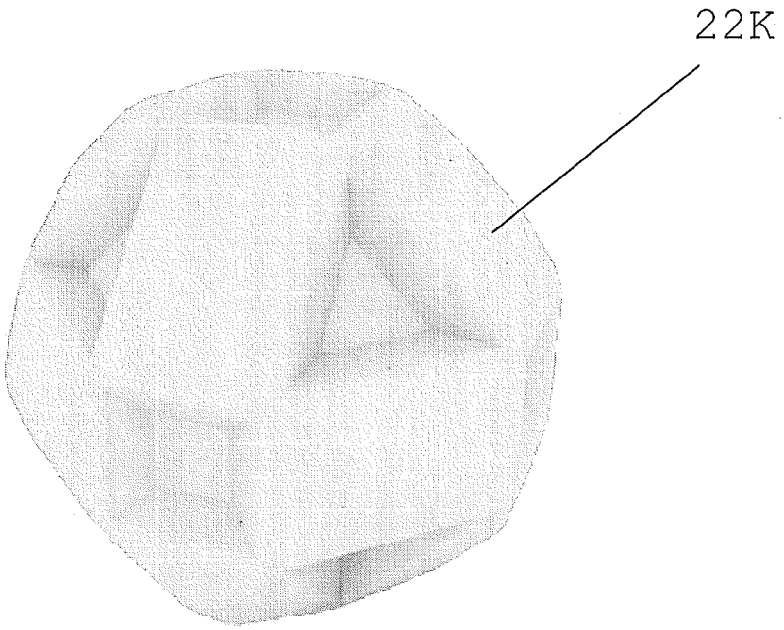

Some or all of the protrusions may furthermore be joined to each other. They may thus be connected to each other. They may therefore be contiguous. One such situation where all protrusions or projections are joined or linked to each other is schematically shown in FIGS. 15 and 16, where a front and a perspective view of a playing object having protrusions of the shape depicted in FIG. 2 is shown. The protrusions 22K do in this embodiment all have the same shape, the rectangular prism shape. They may however be differently shaped. As can be seen the protrusions are joined with each other at the vertices of the rectangular prisms. This means that in this embodiment, the vertex of one protrusion is joined to the vertex of a neighboring protrusion. It should be realized that the protrusions may have other shapes and be joined with each other in other ways. It is also possible that only some are joined with each other.

When protrusions are joined to each other it can be seen that the protrusions in fact provide a playing object surface in which cavities, holes or depressions are provided in a pattern, where these cavities are formed through the previously mentioned main surface. The cavity therefore has a bottom surface forming the element surface, which is distanced a distance from the main surface in a direction from the main surface towards the center of gravity of the playing object. This means that the bottom surface of a cavity is, as seen from the playing object surface, distanced a distance from the playing object surface towards the center of gravity.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention. Therefore, it is manifestly intended that this invention be limited only by the claims and the equivalents thereof.

The invention claimed is:

1. A playing object having a main surface enclosing and provided around a center of gravity, said main surface being provided with elements fixedly joined with the main surface in a pattern around the center of gravity, where each element has an element surface extending away from the main surface, wherein some of the elements differ in appearance from a majority of the elements, wherein the elements are arranged along at least three paths around the centre of gravity, wherein the paths are provided in planes perpendicular to each other with the elements being separated by gaps in each of the paths, and wherein there is at least one element of different shape than the majority in each of the paths.

2. A playing object according to claim 1, wherein the element is a protrusion and the element surface is a protrusion surface distanced a distance from the main surface in a direction that is opposite to the direction from the main surface to the center of gravity.

3. A playing object according to claim 1, wherein the element is a cavity and the element surface is a bottom surface of the cavity distanced a distance from the main surface in a direction from the main surface towards the center of gravity.

4. A playing object according to claim 2, wherein the distance from the main surface to the center of gravity is k times larger than the height of at least said majority of the protrusion surfaces above the main surface, where k is in the range of 3-4.5.

5. A playing object according to claim 2, wherein the protrusions cover 15-75% of the main surface.

6. A playing object according to claim 2, wherein the difference in appearance comprises a different height than the height of the majority of protrusions above the main surface.

7. A playing object according to claim 1, wherein an element of different appearance in one path is separated from an element of different appearance in another path by at least one element having the appearance of the majority.

8. A playing object according to claim 1, wherein all elements of one of the paths have a different appearance than the elements of the other paths.

9. A playing object according to claim 1, wherein, in relation to the plane in which one of the paths is provided, all other paths have a gap between elements in positions perpendicular to this plane.

10. A playing object according to claim 2, wherein the protrusions have at least one side being joined to the underlying main surface and forming a protrusion circumference at the interface with the underlying main surface, where the distance to the center of the protrusion varies along the protrusions circumference.

11. A playing object according to claim 2, wherein protrusions are placed on the main surface so that the distance between the center of one protrusion and the center of a first neighboring protrusion is different from the distance between the center of said one protrusion and the center of a second neighboring protrusion.

12. A playing object according to claim 2, wherein a protrusion surface has the same shape as the part of the main surface from which it protrudes.

13. A playing object according to claim 2, wherein at least some of the protrusions are joined with each other for forming a playing object surface with cavities, which cavities are formed by parts of the main surface provided in-between joined protrusions.

* * * * *